US005503327A

United States Patent [19]

Barnes

[11] Patent Number: 5,503,327

[45] Date of Patent: Apr. 2, 1996

[54] ATTACHED CARTON CONTAINER OPENER

[76] Inventor: Joan B. Barnes, 1115 N. Thornton Ave., Orlando, Fla. 32803

[21] Appl. No.: 361,743

[22] Filed: Dec. 22, 1994

[51] Int. Cl.[6] ..... B65D 5/74

[52] U.S. Cl. ..... 229/160.2; 229/125.42; 229/238

[58] Field of Search ..... 229/125.42, 123.1, 229/123.2, 137, 160.2, 214, 213, 238, 247, 248, 249, 925; 220/279

[56] References Cited

U.S. PATENT DOCUMENTS

| | | | |
|---|---|---|---|
| 3,125,276 | 3/1964 | Zinn | 229/214 |
| 3,520,464 | 7/1970 | Pugh, Sr. | 229/160.2 X |
| 4,821,950 | 4/1989 | Sanchez et al. | 229/160.2 |
| 4,883,222 | 11/1989 | Fujisawa | 229/160.2 |
| 5,322,214 | 6/1994 | Jönsson et al. | 229/160.2 X |
| 5,398,871 | 3/1995 | Vescio | 229/125.42 X |

FOREIGN PATENT DOCUMENTS

| | | | |
|---|---|---|---|
| 4189744 | 7/1992 | Japan | 229/160.2 |
| 8203370 | 10/1982 | WIPO | 229/214 |

*Primary Examiner*—Allan N. Shoap
*Assistant Examiner*—Christopher J. McDonald

[57] ABSTRACT

An attached container opener for facilitating ease of opening of a paperboard carton container. The inventive device includes a container body having a pair of lateral panels coupled to a connecting panel to form an openable pouring spout. A pull tab extending from the connecting panel permits ease of separation of the connecting panel from one of the lateral panels, and an engaging aperture extends through the connecting panel to permit ease of separation of the connecting panel from another one of the lateral panels to open the pouring spout.

7 Claims, 4 Drawing Sheets

ATTACHED CARTON CONTAINER OPENER

BACKGROUND OF THE INVENTION

1. Field of the Invention

The present invention relates to container structures and more particularly pertains to an attached carton container opener for facilitating ease of opening of a paperboard carton container.

2. Description of the Prior Art

The use of container structures is known in the prior art. More specifically, container structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art container structures include U.S. Pat. No. 5,135,159; U.S. Pat. No. 5,197,662; U.S. Pat. No. 5,035,330; U.S. Pat. No. 3,450,328; and U.S. Pat. No. 3,355,083.

While these devices fulfill their respective, particular objectives and requirements, the aforementioned patents do not disclose an attached carton container opener for facilitating ease of opening of a paperboard carton container which includes a container body having a pair of lateral panels coupled to a connecting panel to form an openable pouring spout, a pull tab extending from the connecting panel to permit separation of the connecting panel from one of the lateral panels, and an engaging aperture extending through the connecting panel to permit ease of separation of the connecting panel from another one of the lateral panels to open the pouring spout of the container.

In these respects, the attached carton container opener according to the present invention substantially departs from the conventional concepts and designs of the prior art, and in so doing provides an apparatus primarily developed for the purpose of facilitating ease of opening of a paperboard carton container pouring spout.

SUMMARY OF THE INVENTION

In view of the foregoing disadvantages inherent in the known types of container structures now present in the prior art, the present invention provides a new attached carton container opener construction wherein the same can be utilized for facilitating ease of opening of a paperboard carton container. As such, the general purpose of the present invention, which will be described subsequently in greater detail, is to provide a new attached carton container opener apparatus and method which has many of the advantages of the container structures mentioned heretofore and many novel features that result in an attached carton container opener which is not anticipated, rendered obvious, suggested, or even implied by any of the prior art container structures, either alone or in any combination thereof.

To attain this, the present invention generally comprises an attached container opener for facilitating ease of opening of a paperboard carton container. The inventive device includes a container body having a pair of lateral panels coupled to a connecting panel to form an openable pouring spout. A pull tab extending from the connecting panel permits ease of separation of the connecting panel from one of the lateral panels, and an engaging aperture extends through the connecting panel to permit ease of separation of the connecting panel from another one of the lateral panels to open the pouring spout.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new attached carton container opener apparatus and method which has many of the advantages of the container structures mentioned heretofore and many novel features that result in an attached carton container opener which is not anticipated, rendered obvious, suggested, or even implied by any of the prior art container structures, either alone or in any combination thereof.

It is another object of the present invention to provide a new attached carton container opener which may be easily and efficiently manufactured and marketed.

It is a further object of the present invention to provide a new attached carton container opener which is of a durable and reliable construction.

An even further object of the present invention is to provide a new attached carton container opener which is susceptible of a low cost of manufacture with regard to both materials and labor, and which accordingly is then susceptible of low prices of sale to the consuming public, thereby making such attached carton container openers economically available to the buying public.

Still yet another object of the present invention is to provide a new attached carton container opener which provides in the apparatuses and methods of the prior art some of the advantages thereof, while simultaneously overcoming some of the disadvantages normally associated therewith.

Still another object of the present invention is to provide a new attached carton container opener for facilitating ease of opening of a pouring spout of a paperboard carton container.

Yet another object of the present invention is to provide a new attached carton container opener which includes a container body having a pair of lateral panels coupled to a connecting panel to form an openable pouring spout, a pull tab extending from the connecting panel to permit separation of the connecting panel from one of the lateral panels, and an engaging aperture extending through the connecting panel to permit ease of separation of the connecting panel from another one of the lateral panels to open the pouring spout of the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
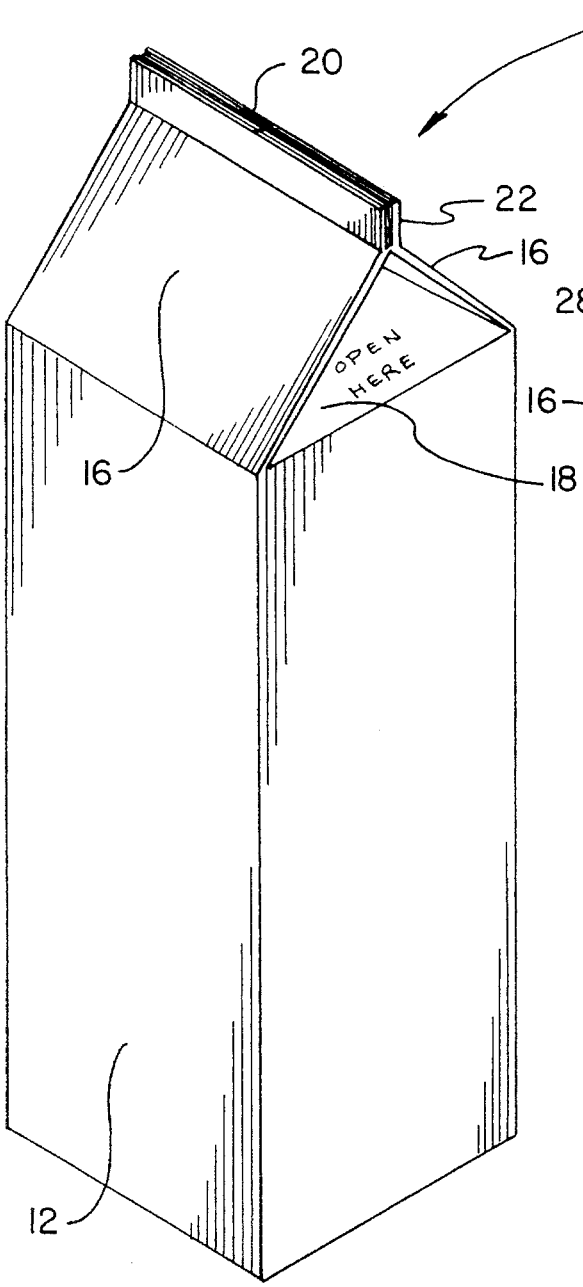
FIG. 1 is an isometric illustration of an attached carton container opener according to the present invention.

With reference now to the drawings, and in particular to FIGS. 1–7 thereof, a new attached carton container opener embodying the principles and concepts of the present invention and generally designated by the reference numeral 10 will be described.

Figure 5:
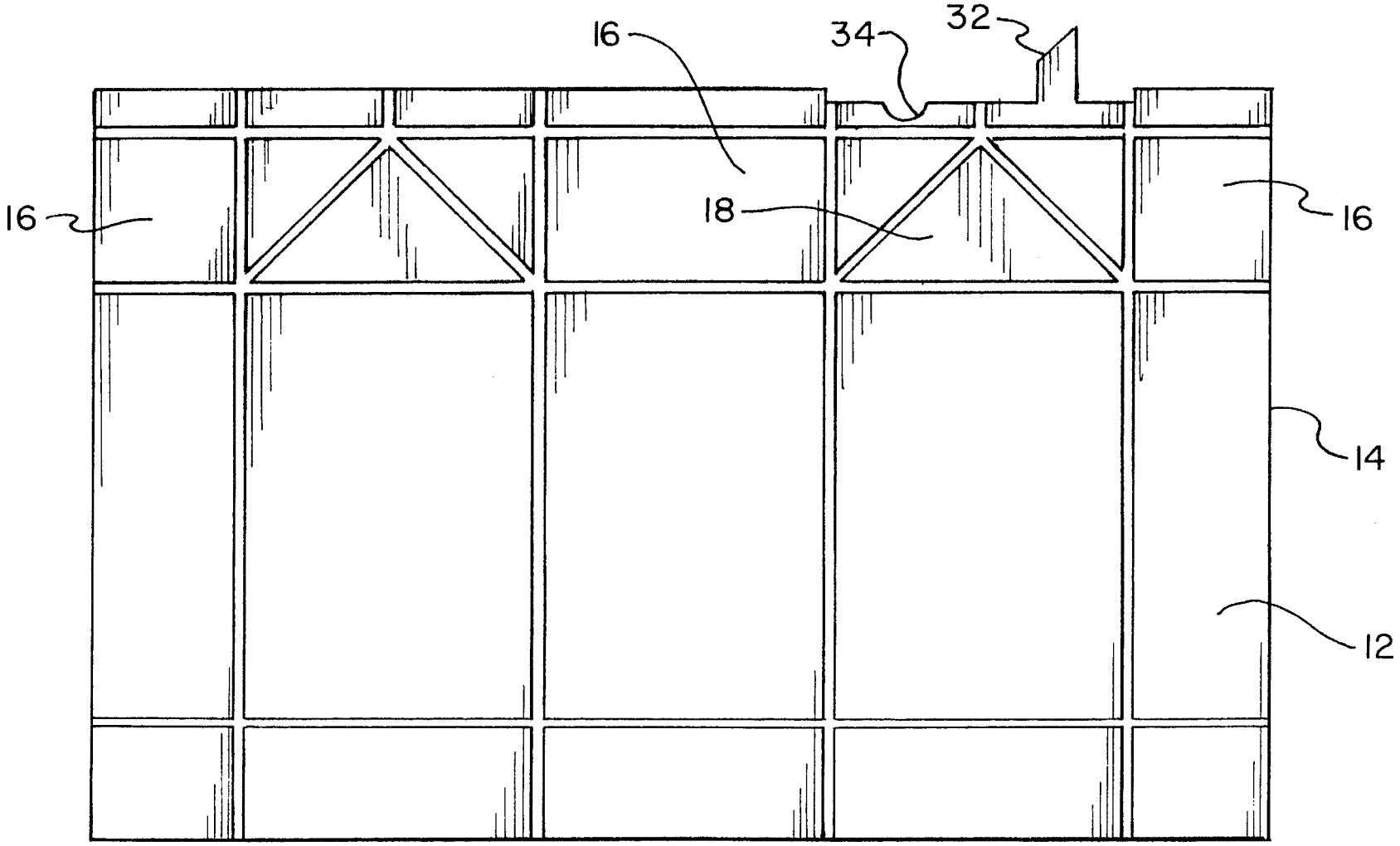
FIG. 5 is a plan view of a blank utilized in a construction of the present invention.

More specifically, it will be noted that the attached carton container opener 10 comprises a substantially rectangular container body 12 formed from a plurality of integrally connected and unlabelled panels cooperating to define a blank 14, as shown in FIG. 5, which can be folded and joined so as to form the container body. The container body 12 when folded and joined together as illustrated in FIG. 1 includes a pair of lateral panels 16, with a connecting panel 18 extending between the lateral panels and folded about a pair of unlabelled fold lines. The lateral panel 16 of the container body 12, when the connecting panel 18 is folded about the unlabelled fold lines will be positioned into an abutting relationship and secured thereto by a releasable adhesive to form a frangible apex seal 20 of the container closure 22. The frangible apex seal 20 of the container closure 22 can be partially broken through an outward biasing of the lateral panels 16 into the orientation illustrated in FIG. 2.

Figure 2:
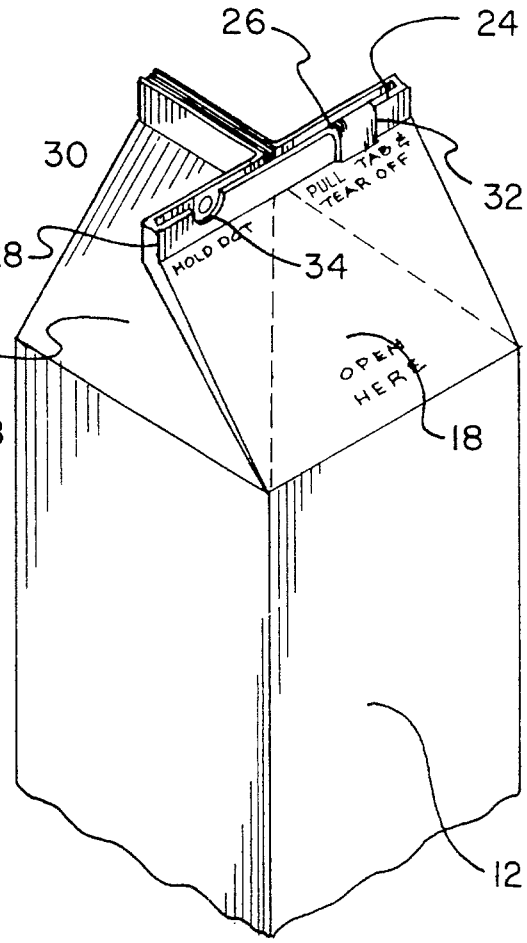
FIG. 2 is an isometric illustration of the present invention in a partially opened configuration.
Figure 3:
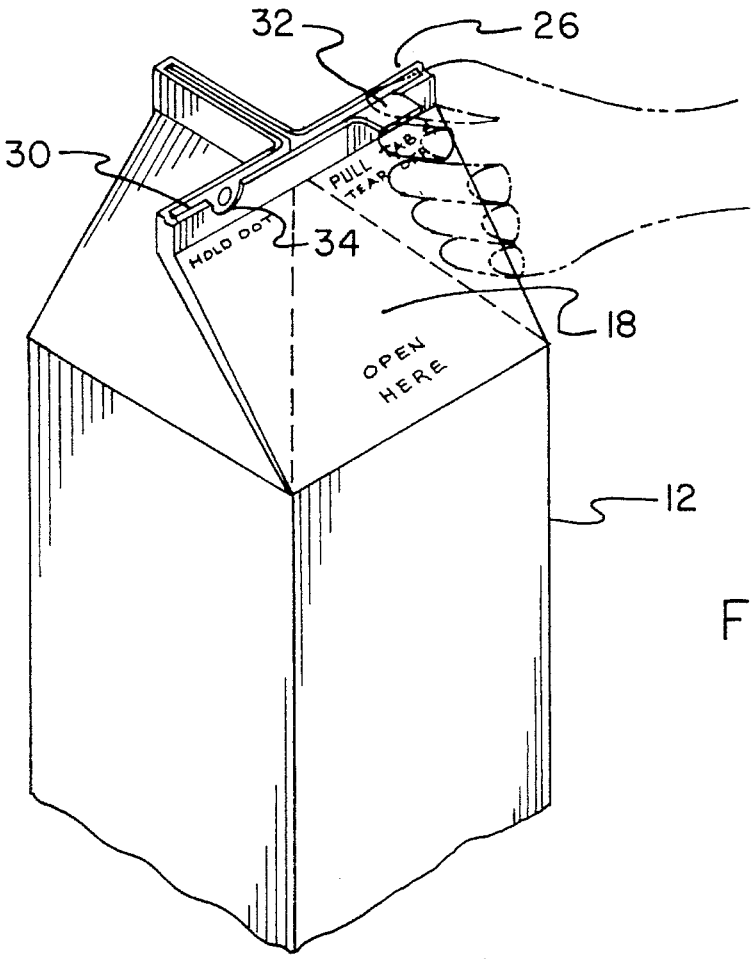
FIG. 3 is a further isometric illustration of the device in a partially opened configuration.
Figure 4:
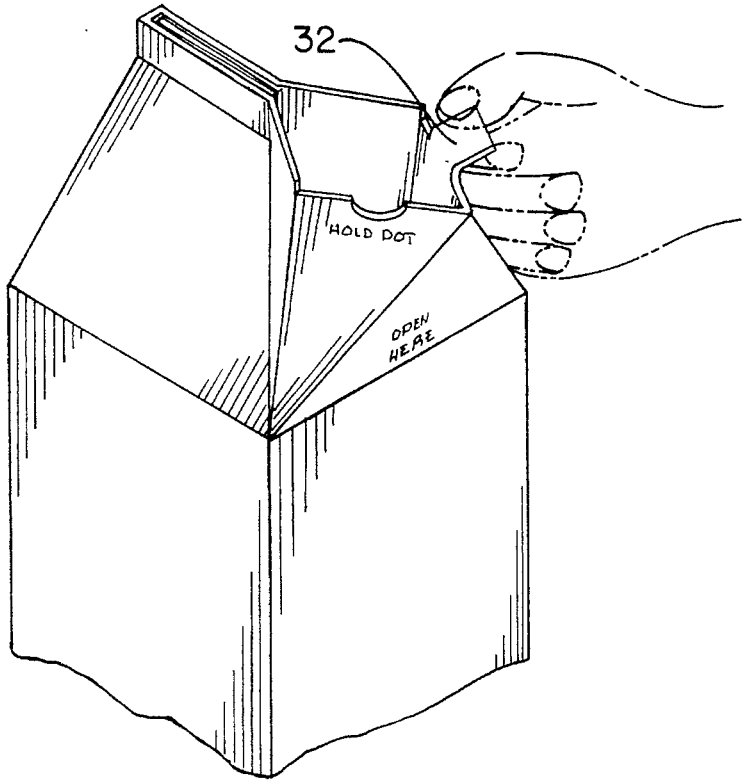
FIG. 4 is an isometric illustration of a portion of the invention with the pouring spout in an opened configuration.

When the container closure 22 is partially opened as illustrated in FIGS. 2 and 3, the connecting panel 18 is joined along an upper edge thereof to the lateral panels 16 to define a first wing portion 24 having a first frangible wing seal 26 coupling the upper edge of the connecting panel 18 to a first one of the lateral panels 16. Similarly, a second wing portion 28 includes a second frangible wing seal 30 coupling the upper edge of the connecting panel 18 to a second one of the lateral panels 16. An integral pull tab 32 is coupled to the upper edge of the connecting panel 18 proximal to the first frangible wing seal 26 of the first wing portion 24, whereby the pull tab 32, as shown in FIG. 3, can be grasped and manipulated by an individual to effect breaking of the first frangible wing seal 26 to separate the upper edge of the connecting panel 18 from the first one of the lateral panels 16. To permit grasping of the container body 12 during pulling of the integral pull tab 32 while simultaneously assisting in the separation of the upper edge of the connecting panel 18 from the second one of the lateral panels 16, an engaging aperture 34 of semi-circular configuration is directed through the connecting panel 18 proximal to the upper edge thereof. Thus, an individual can grasp an upper edge of the second one of the lateral panels 16 through the engaging aperture 34 of the upper edge of the connecting panel 18 during pulling of the integral pull tab 32 to facilitate breaking of the second frangible wing seal 30 of the second wing portion 28 subsequent to the breaking of the first frangible wing seal 26 of the first wing portion 24. Preferably, instructive indicia is printed onto the connecting panel 18 directing a user to perform such opening method. In this connection it is preferable for the indicia to include a circular dot printed on the upper edge of the second one of the lateral panels 16 so as to be viewable through the engaging aperture 34 of the connecting panel 18, whereby the instructive indicia instructs an individual to grasp the upper edge of the second one of the lateral panels 16 proximal to the dot. By this structure, an individual can retain the container body 12 against a force being applied to the pull tab 32, while simultaneously retaining the upper edge of the second one of the lateral panels 16 during breaking of the second frangible wing seal 30.

As shown in FIG. 5, the integral pull tab 32 can be shaped so as to define an angled edge extending proximal to and substantially parallel with one of the fold lines of the connecting panel 18.

Figure 6:
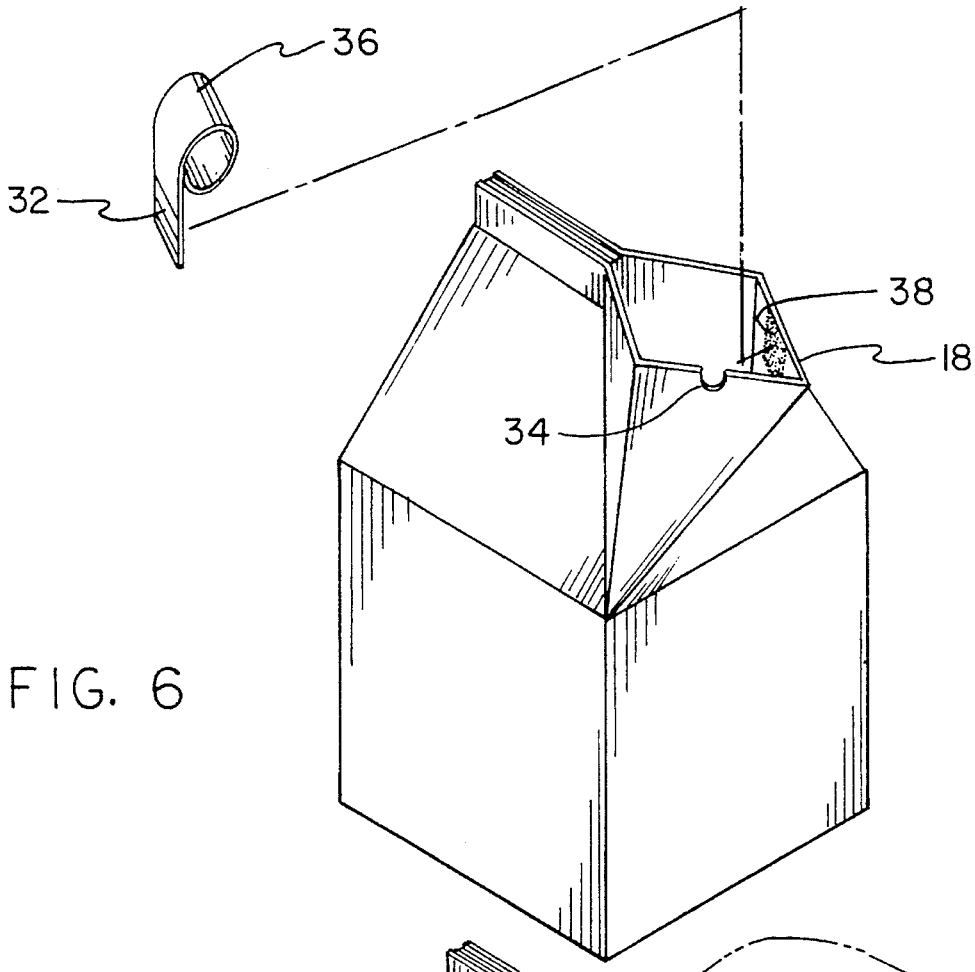
FIG. 6 is an exploded isometric illustration of an alternative form of the present invention.
Figure 7:
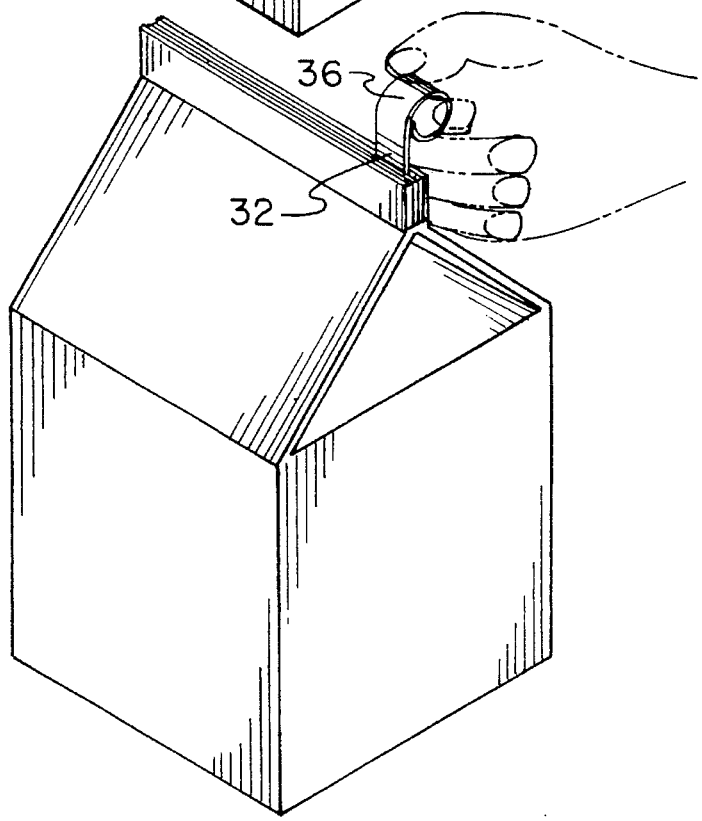
FIG. 7 is an isometric illustration of the alternative form of the present invention in use.

As shown in FIGS. 6 and 7, the pull tab 32 may be configured as a separate tab member including a hollow cylindrical finger loop 36. In this configuration, the pull tab 32 is coupled to the connecting panel 18 by an adhesive 38. As shown in FIG. 7, the finger loop 36 is operable to receive an individual digit of the human hand therethrough during the initial separation of the frangible apex seal 20, as well as during a separation of the upper edge of the connecting panel 18 from the first one of lateral panels 16 and subsequently during a separation of the upper edge of the connecting panel from the second one of the lateral panels 16. Preferably, the finger loop 36, as well as the rest of the pull tab 32, is constructed of a material differing from the paperboard of the blank 14 or container body 12 so to be of a more rigid construction relative to the container body 12. Examples of such differing materials include a suitable metal or plastic material.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. An attached carton container opener comprising:

a substantially rectangular container body formed from a plurality of connected panels, the container body including a pair of lateral panels, with a connecting panel extending between the lateral panels and being folded about a pair of fold lines such that the lateral panels of the container body are positioned into an abutting relationship, the lateral panels being releasably secured together to form a frangible apex seal, the connecting panel being joined along an upper edge thereof to the lateral panels to define a first wing portion having a first frangible wing seal coupling the upper edge of the connecting panel to a first one of the lateral panels, and a second wing portion including a second frangible wing seal coupling the upper edge of the connecting panel to a second one of the lateral panels;

and, pull tab means for facilitating breaking of the first frangible wing seal to separate the upper edge of the connecting panel from the first one of the lateral panels, the pull tab means comprising a pull tab coupled to the upper edge of the connecting panel proximal to the first frangible wing seal of the first wing portion such that the pull tab resides between an outer edge of the first wing portion and a juncture of the connecting panel with the first wing portion and the second wing portion, with no additional structure projecting from the connecting panel at the juncture of the connecting panel with the first wing portion and the second wing portion, whereby the pull tab can be grasped and manipulated by an individual to effect breaking of the first frangible wing seal to separate the upper edge of the connecting panel from the first one of the lateral panels.

2. The attached carton container opener of claim 1, wherein an engaging aperture is directed through the connecting panel proximal to the upper edge thereof to permit grasping of the container body during pulling of the pull tab while simultaneously assisting in the separation of the upper edge of the connecting panel from the second one of the lateral panels.

3. The attached carton container opener of claim 2, and further comprising instructive indicia means printed onto the connecting panel for directing a user to open the carton container.

4. The attached carton container opener of claim 3, wherein the instructive indicia means includes a circular dot printed on an upper edge of the second one of the lateral panels so as to be viewable through the engaging aperture of the connecting panel, the instructive indicia means further including words instructing an individual to grasp the upper edge of the second one of the lateral panels proximal to the dot.

5. The attached carton container opener of claim 4, wherein the pull tab is integral with the connecting web and is shaped so as to define an angled edge extending proximal to and substantially parallel with one of the fold lines of the connecting panel.

6. The attached carton container opener of claim 4, wherein the pull tab is configured as a separate tab member coupled to the connecting web and including a hollow cylindrical finger loop.

7. The attached carton container opener of claim 6, wherein the pull tab is constructed of a material differing from a material of the container body so to be of a more rigid construction relative to the container body.

* * * * *